United States Patent [19]

Stuckmann

[11] 4,334,800

[45] Jun. 15, 1982

[54] TUNNEL DRIVE SHIELD

[75] Inventor: Dieter Stuckmann, Selm, Fed. Rep. of Germany

[73] Assignee: Gewerkschaft Eisenhutte Westfalia, Fed. Rep. of Germany

[21] Appl. No.: 188,073

[22] Filed: Sep. 17, 1980

[30] Foreign Application Priority Data

Sep. 19, 1979 [DE] Fed. Rep. of Germany ..... 2937826

[51] Int. Cl.[3] ..... E21D 19/00

[52] U.S. Cl. ..... 405/145; 405/141; 405/288

[58] Field of Search ..... 405/139–146, 405/288, 290, 291, 298, 299, 303; 299/31, 33; 175/219

[56] References Cited

U.S. PATENT DOCUMENTS

| | | | |
|---|---|---|---|
| 3,784,159 | 1/1974 | Skattman et al. | 175/219 X |
| 3,812,680 | 5/1974 | Walbrohl | 405/290 |
| 3,998,067 | 12/1976 | Fernandez | 405/145 |
| 4,173,421 | 11/1979 | Harhoff et al. | 405/288 X |

FOREIGN PATENT DOCUMENTS

| | | | |
|---|---|---|---|
| 2714923 | 9/1978 | Fed. Rep. of Germany | 405/145 |
| 2044333 | 10/1980 | United Kingdom | 405/145 |

*Primary Examiner*—Dennis L. Taylor

*Attorney, Agent, or Firm*—Thompson, Birch, Gauthier & Samuels

[57] ABSTRACT

A tunnel drive shield has an arcuate support frame constituted by a pair of foot segments, a pair of wall segments supported by the foot segments and a ridge segment connecting the tops of the wall segments. The foot segments engage the tunnel floor, and the wall segments are braceable outwardly towards the tunnel walls. Each foot segment is provided with a pair of longitudinal floor skids displaceably mounted on the base thereof. Each foot segment is also provided with a pair of longitudinally-spaced, vertically-movable support feet, which are movable into contact with the tunnel floor to relieve, at least partially, the load on the floor skids. The support feet are used to support the shield while the floor skids are removed. The rest of the shield can then be dismantled within the confines of the tunnel.

26 Claims, 7 Drawing Figures

TUNNEL DRIVE SHIELD

BACKGROUND OF THE INVENTION

This invention relates to a drive shield for use in forming underground tunnels, mine galleries or other elongate underground excavations, and the terms "tunnel" or "tunnelling" should be construed throughout this specification accordingly. The invention is particularly useful for driving the galleries (or roads) of underground mine workings.

A tunnel drive shield is known having a plurality of elongate drive members (or knives) carried by a support frame. The knives are positioned in a parallel side-by-side relationship to define a wall-contacting shell. The knives can be advanced, individually or in groups, relative to the support frame by means of hydraulic rams. The support frame of this shield is constituted by two components which are pivotably interconnected at the roof and carried by hydraulic props. The frame components are also connected together at the floor by means of a beam whose length can be varied by means of hydraulic rams. (See British Patent Specification No. 1463194).

Another known tunnel drive shield of this general type has a support frame having a pair of foot segments engageable with the tunnel floor, and a plurality of main segments which can be braced outwardly, by means of hydraulic rams, towards the tunnel walls. The main segments are connected to their foot segments by means of telescopic guides, and the hydraulic bracing rams are arranged to apply their bracing forces roughly in the axial direction of the telescopic guides. The foot segments of the support frame are provided with floor skids, on which the entire shield is supported. (See U.S. Pat. No. 4,173,421).

The disadvantage of these known tunnel drive shields is that it is very difficult to assemble and dismantle them in the constricted space of underground tunnels or galleries. In practice, the assembly and dismantling of such shields necessitates special underground work chambers whose cross-sections are considerably greater than that of the tunnel being formed. The provision of these large work chambers results in a considerable amount of extra work, and involves additional high costs. Moreover, it leads to excessively long assembly and dismantling times.

The aim of the invention is to provide a tunnel drive shield which can be assembled and dismantled within the cross-section of the tunnel being driven.

SUMMARY OF THE INVENTION

The present invention provides a tunnel drive shield having an arcuate support frame constituted by a pair of foot segments and a plurality of main segments supported by the foot segments, the foot segments being engageable with the tunnel floor, and the main segments being braceable outwardly towards the tunnel walls, each foot segment being provided with at least one floor skid displaceably mounted on the base thereof, wherein each foot segment is provided with at least one vertically-movable support foot, the support feet being movable into contact with the tunnel floor to relieve, at least partially, the load on the floor skids.

Advantageously, the main segments of the support frame carry a plurality of elongate members which are arranged in parallel side-by-side relationship, the elongate members being engageable with the tunnel walls and being movable relative to the support frame in the direction of tunnel advance. Preferably, each elongate member is provided with a hydraulic advance ram for advancing that elongate member relative to the support frame; and each elongate member slidably engages a respective guide extending parallel to the longitudinal axis of the shield, whereby the elongate members are removable from the support frame by movement in the longitudinal direction. Also, each floor skid may slidably engage a respective guide extending longitudinally along the base of the corresponding food segment, whereby the floor skids are removable from the foot segments by movement in the longitudinal direction. Thus, the elongate members and the floor skids can be removed from the shield in the direction of its tail.

Advantageously, each foot segment is provided with two floor skids, and each foot segment is provided with two longitudinally spaced support feet. The support feet may be movable vertically by means of hydraulic lifting rams, and each support foot may be detachably secured to the respective foot segment.

Preferably, the main segments comprise two wall segments and a rigid segment, each of the wall segments being connected to a respective one of the foot segments, and the two wall segments being joined together, at the top, by the ridge segment. Conveniently, each wall segment is connected to its foot segment by telescopic guide means, and the top of each wall segment is connected to the ridge segment by telescopic guide means. Advantageously, the telescopic guide means at the base of each wall segment is constituted by a first telescopic guide situated adjacent to each end thereof, and the telescopic guide means at the top of each wall segment is constituted by a second telescopic guide situated adjacent to each end thereof. Preferably, each first telescopic guide is constituted by a tongue-like member attached to the respective wall segment, and by a grooved guide member attached to the corresponding foot segment, each tongue-like member being a telescopic fit within its grooved guide member. Advantageously, each first telescopic guide is such that its tongue-like member can be completely removed from its grooved guide member when the support frame is braced outwardly, and the elongate members and the floor skids have been removed. Similarly, each second telescopic guide may be constituted by a tongue-like member attached to the ridge segment, and by a grooved guide member attached to the respective wall segment, each tongue-like member being a telescopic fit within its grooved guide member.

During dismantling, the shield can, in some cases, be raised to such an extent, with the aid of the support feet, that the floor skids are completely relieved of load, and can be removed. The shield can then be set on the tunnel floor by raising the support feet so that the shield rests on its foot segments. As this happens, sufficient free space is created between the tunnel walls and the elongate members to enable the latter to be removed. The support frame, thus stripped of its floor skids and its elongate members, is then of sufficiently small cross-section to be dismantled within the tunnel cross-section.

Advantageously, the shield further comprises hydraulic rams for bracing the main segments of the support frame outwardly towards the tunnel walls. Preferably, at least one of said hydraulic bracing rams is associated with, and acts generally in the direction of, each of the telescopic guides. In this case, the hydraulic bracing rams can be used to assemble and dismantle the segments of the support frame.

The tongue-like member of each first telescopic guide may be pivotally attached to its wall segment. This enables the parts of the first telescopic guides to slide easily without undue force. Advantageously, the tongue-like member of each first telescopic guide is provided with detachable means for securing that tongue-like member rigidly to its wall segment.

The tunnel drive shield of the invention can also be dismantled in a tunnel whose cross-section is less than its desired (nominal) cross-section. This reduction in cross-section occurs in cases where the pressure of the surrounding earth and rock is sufficiently great. In such cases, the support frame of the shield is contracted to an extent sufficient to relieve the pressure on the shield from the surrounding earth and rock. The shield can then be dismantled. Advantageously, however, the dismantling process is facilitated if the tongue-like members of the first telescopic guides are detachably secured to their wall segments. This enables the wall segments to be separated from the foot segments without having to re-brace the wall segments outwardly. In such cases, it is also possible to withdraw the floor skids when loaded. This can be done using the hydraulic advance rams provided for advancing the floor skids relative to their foot segments. In order to assist with this skid removal step, each floor skid may be provided with a plurality of longitudinally-spaced engagement points for its associated hydraulic advance ram, whereby said ram can be used to displace that floor skid in the rearward longitudinal direction relative to its foot segment. This enables the skids to be forced out to the rear of the shield in incremental movements.

Advantageously, each elongate member is provided with openings through which holes can be drilled in the tunnel walls from the inside of the shield.

Preferably, each wall segment is constituted by a plurality of detachably connected segment parts.

A tunnel drive shield constructed in accordance with the invention will now be described, by way of example, with reference to the accompanying drawings, in which.

DESCRIPTION OF PREFERRED EMBODIMENT

Figure 1:
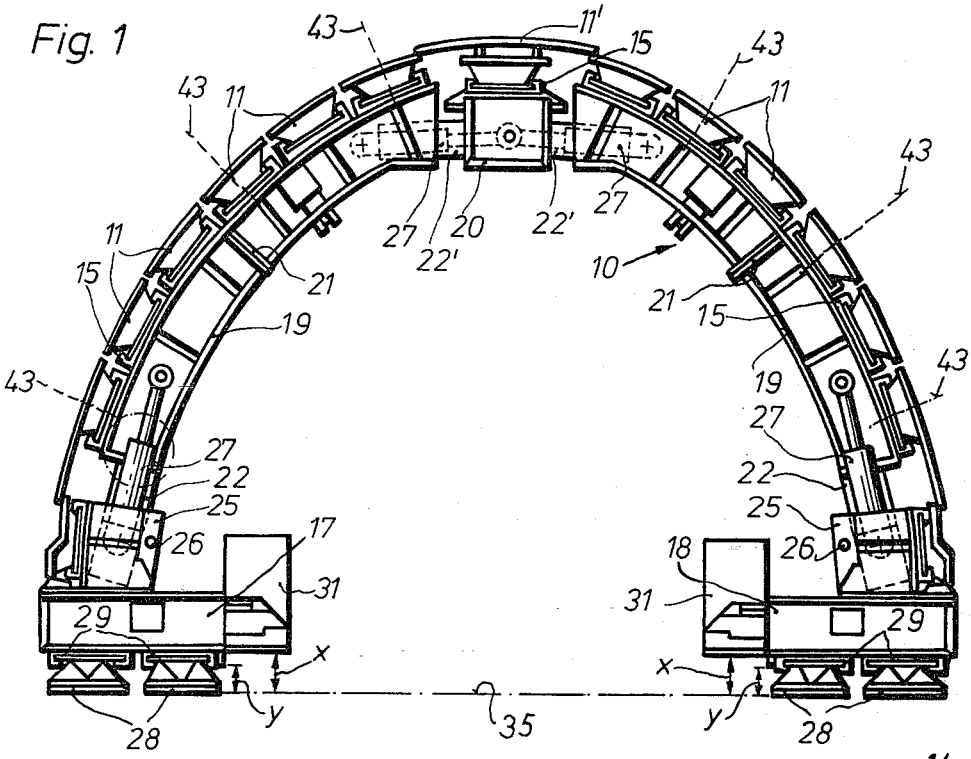
FIG. 1 is an end elevation of the tunnel drive shield.

Referring to the drawings, FIG. 1 shows a tunnel drive shield of arcuate cross-section. The shield has a support frame 10 which carries a plurality of elongate members (knives) 11 and 11' having cutting edges 12 at their front ends. Each of the knives 11, 11' is provided with a tail extension 13; the tail extensions being articulated to their knives, and forming a hood. This hood affords protection for erecting a support 14 of a permanent tunnel lining.

Each of the knives 11,11' is displaceably guided, for movement in the direction V of tunnel advance, in a respective T-shaped, longitudinally-extending, guide groove 15 formed in the support frame 10. Each knife 11,11' is provided with a double-acting hydraulic advance ram 16 (only one of which is shown—see FIG. 2) which is pivotally attached to that knife and to the support frame. The knives 11,11' are advanced (either singly or in groups) in the direction V by extending the rams 16, the support frame 10 providing an abutment for the advance movement of the knives. Once all the knives 11,11' have been advanced, the support frame 10 can be advanced, in a follow-up step, by retracting all the rams 16 simultaneously, friction between the knives and the surrounding tunnel walls providing an abutment for the frame advance.

The support frame 10 is formed as a multipart, expansible frame. It has two foot segments 17 and 18 which support wall segments 19 and a ridge segment 20. The two foot segments 17 and 18 are of a similar construction, and the ridge segment 20 interconnects the two wall segments 19 at the tops thereof. The knives 11 are displaceably mounted on the wall segments 19, whereas the knife 11' (which is somewhat wider than the knives 11) is displaceably mounted on the ridge segment 20. The knife 11' overlies the longitudinal edges of the two adjacent knives 11, so that a closed covering is provided at the top of the shield.

The wall segments 19 are curvilinear, are symmetrically disposed about the axis of the shield, and are of hollow box-like construction. Each wall segment 19 is of two-part construction, the two parts being bolted together, at 21.

Each of the wall segments 19 is pivotally mounted to its foot segment 17 or 18 respectively by means of two telescopic guides arranged at the two ends of the shield. As shown best in FIG. 7, each of the telescopic guides associated with the foot segment 17 is constituted by a tongue-like member 22 which telescopically engage within a groove 24 formed in a guide member 25. The tongue-like members 22 are pivotally connected, by means of pivot pins 23, to the lower end of the wall segment 19; and the guide members 25 are pivotally mounted, by means of pivot pins 26, on the foot segment 17. The telescopic guides associated with the foot segment 18 are identical to those associated with the foot segment 17.

A respective pair of hydraulic rams 27 is associated with each of the telescopic guides, the rams of each pair sandwiching their respective telescopic guide. Each ram 27 is pivotally mounted between its associated wall and foot segments 19,17 or 19,18. Thus expansion of the rams 27 causes the wall segments 19 to be raised relative to the foot segments 17 and 18, this movement being guided by the telescopic guides.

Similarly, the ridge segment 20 is coupled to the tops of the wall segments 19 by means of telescopic guides at each end thereof. Each of these telescopic guides has a tongue-like member 22' (see FIG. 1) attached to the side of the ridge segment 20, the tongue-like member 22' being telescopically engageable within guide members (not shown) at the tops of the wall segment 19. Here again, a pair of hydraulic rams 27' is associated with each of the telescopic guides. Each ram 27' is pivotally mounted between the ridge segment 20 and one of the wall segments 19. The rams 27' are used to expand the wall segment laterally towards the wall of the tunnel.

Each of the foot segments 17 and 18 is provided with a pair of floor skids 28. Each of the floor skids 28 has a top portion shaped to engage within a respective T-shaped groove 29 formed in the underside of the associated foot segment 17 or 18. The grooves 29 extend longitudinally, and constitute guides along which the floor skids 28 are slidable. Each floor skid 28 is provided with a double-acting hydraulic ram 30, which is pivotally mounted between that floor skid and the associated foot segment 17 or 18. The rams 30 are used to move the floor skids 28, in the direction V, relative to the rest of the shield. The support frame 10 can then be moved forward, in a follow-up movement, the floor skids 28 forming a slide bearing for the foot segments 17 and 18 during this movement.

Figure 2:
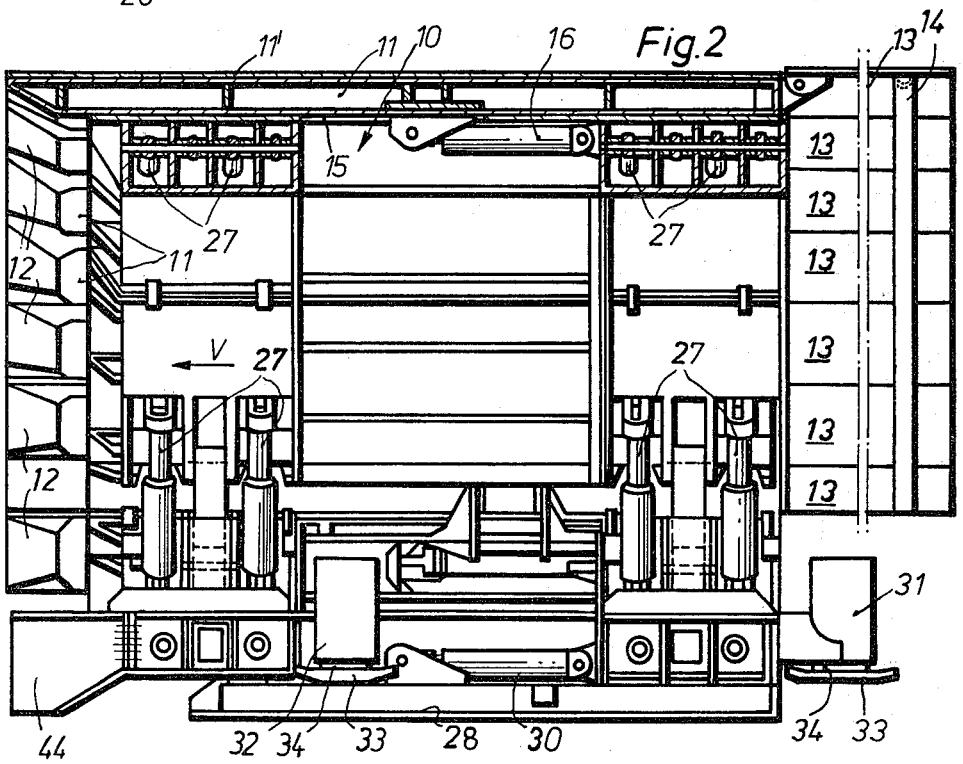
FIG. 2 is a longitudinal section through the shield of FIG. 1.
Figure 3:
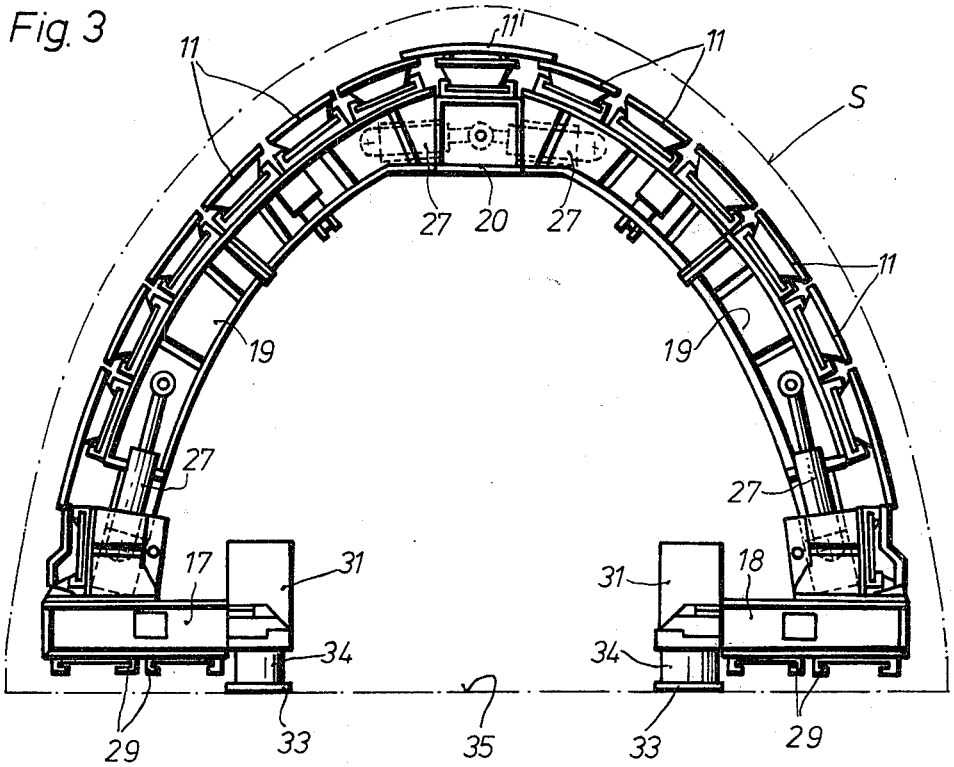
FIGS. 3 & 4 are end elevations of the shield of FIG. 1, and show different stages of the shield dismantling process.
Figure 4:
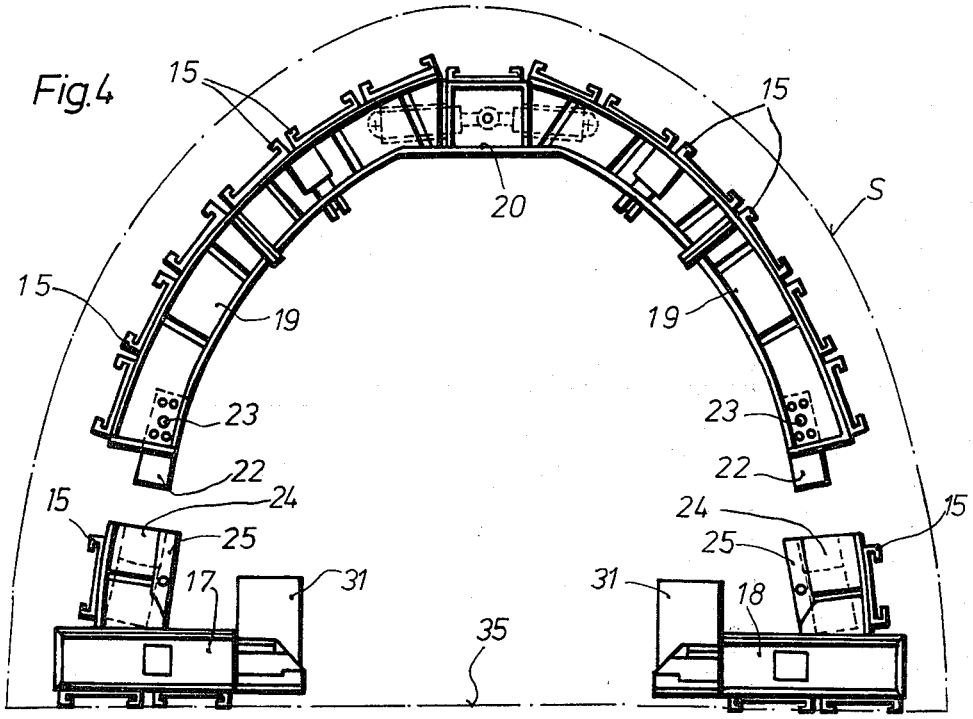

Each foot segment 17,18 is provided with a pair of longitudinally-spaced support feet 31 and 32 (see FIG. 2). As shown in FIGS. 1,3 and 4, the feet 31 (and 32) are inwardly offset in relation to the floor skids 28. Each of the support feet 31,32 is provided with a base plate 33 which is vertically movable towards (and away from) the tunnel floor 35 by means of a respective hydraulic ram 34. In their uppermost (fully retracted) positions, the base plates 33 have a ground clearance X (see FIG. 1), this clearance being at least equal to (and preferably slightly greater than) the distance Y between the tunnel floor 35 and the bases of the T-shaped grooves 29. The support feet 31 and 32 may be solidly or detachably connected to their foot segment, 17 and 18.

As shown in FIG. 1, the shield is outwardly braced, by means of the rams 27 and 27', to conform with the desired cross-section of the tunnel. During normal use of the shield, the support feet 31 and 32 are fully retracted, so that the shield rests on the tunnel floor 35 on its skids 28. In order to dismantle the shield once the tunnel has been completed, all the rams 27 and 27' are retracted so that the knives 11 and 11' are withdrawn inwardly away from the tunnel walls S (see FIG. 3). The support feet 31 and 32 are then forced down, by the rams 34, into contact with the tunnel floor 35. This lifts the floor skids 28 away from the tunnel floor 35, so that the entire weight of the shield is borne by the support feet. The floor skids 28 can then be withdrawn from the T-shaped grooves 29 towards the tail of the shield. Next, the support feet 31 and 32 are retracted so that the shield is lowered until it is supported on the tunnel floor 35 by means of its foot segments 17 and 18 (see FIG. 4). During this lowering operation, a free space is created between the tunnel walls S and the outer surface of the shield. This free space has a greater radial dimension than that through which the shield segments 19 and 20 can be braced by the rams 27 and 27'. The knives 11 and 11' can then be withdrawn from their T-shaped grooves towards the tail of the shield.

In order to dismantle the support frame 10, the rams 27 are then fully extended. As this happens, the tongue-like members 22 move out of the grooves 24 of their guide members 25 (see FIG. 4). The upper segments 19 and 20 of the support frame 10 can then be held in this position (using, for example, a block-and-tackle), whilst the rams 27 are removed. The foot segments 17 and 18, which are now exposed, can then be removed either in one piece or part-by-part. It is then possible to lower the upper segments 19 and 20 on to the tunnel floor 35, and to separate the segments 19 from the segment 20. The segments 19 and 20 can then be transported to the next location at which the shield is to be used.

Obviously, the shield is assembled in the reverse order to that described above, this assembly process also being possible within the confines of the tunnel to be formed.

The shield can also be assembled, and dismantled, in a tunnel whose cross-section is smaller than the desired (or nominal) cross-section, this reduction in cross-section occurring because of the pressure of the surrounding earth and rock. When such pressure occurs, the shield contracts slightly as its rams 27 and 27' retract in taking up the pressure. If the rams 27 and 27' are fully retracted by such pressure, the shield is dismantled in the following manner. Firstly, the support feet 31 and 32 are extended until their base plates 33 bear against the tunnel floor 35. Then, the floor skids 28 (which are still under load) are withdrawn from their T-shaped grooves 29 towards the shield tail, this being achieved with the aid of suitable auxiliary equipment. After removal of the skids 28, the support feet 31 and 32 are retracted sufficiently far to lower the shield so that the foot segments 17 and 18 rest on the tunnel floor 35. The telescopic connection between the foot segments 17 and 18 and the wall segments 19 is then released by removing the pivot pins 23 of the tongue-like members 22. The members 22 can then be displaced upwards within the wall segments 19 until they move out of engagement with the grooves 24 of the guide members 25. This releases the foot segments 17 and 18, which can then be carried away. The upper segments 19 and 20 can then be dismantled in the manner described above.

Figure 5:
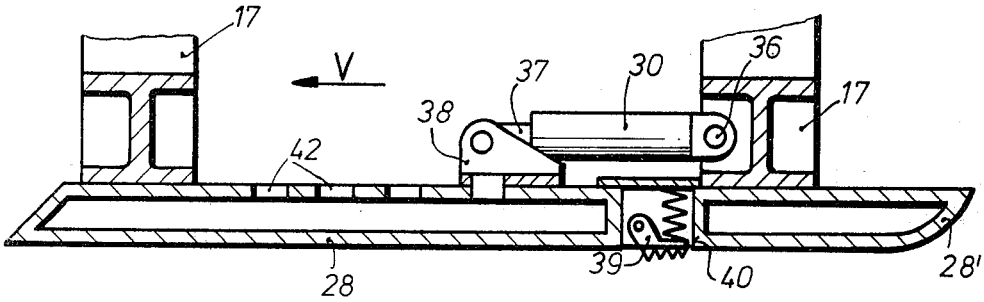
FIGS. 5 & 6 are longitudinal sections through a floor skid of the shield of FIG. 1, and show different operational positions of the floor skid.
Figure 6:
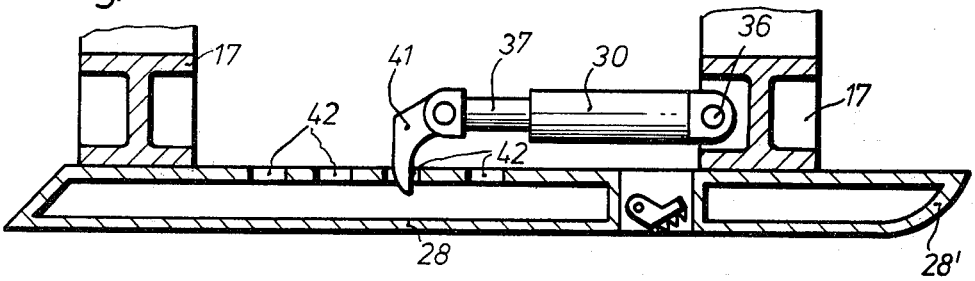

Particularly when the floor skids 28 have to be removed whilst under load, it is advisable to make use of the rams 30. As shown in FIG. 5, each ram 30 is pivotally connected to its foot segment 17 (or 18) and to its floor skid 28 by means of pivot joints 36. The piston rods 37 of the rams 30 are detachably connected to the associated floor skids 28 by means of respective links 38. The rear end 28' of each floor skid 28 is curved upwardly, and each floor skid is provided with a pawl 39 housed within a downwardly-open recess formed in the base of that floor skid forwardly of the curved end portion. The pawl 39 of each floor skid is biassed down into contact with the tunnel floor 35 by means of a spring 40. The pawls 39 thus act to prevent the floor skids 28 from moving in a direction opposite to the direction V of tunnel advance. In order to remove a given floor skid 28, its spring 40 is removed (or rendered ineffective), and the link 38 is released from the skid and replaced by a hook-shaped coupling member 41 (see FIG. 6). The coupling member 41 is fixed to the piston rod 37 of the associated ram 30, so that its free end can engage in one of a series of longitudinally-spaced holes 42 formed in the top surface of the floor skid 28 (which is of hollow box-girder formation). The coupling member 41 is engaged with one of the holes 42 when the ram 30 is fully extended. The ram 30 is then fully retracted so that the floor skid 28 is moved towards the shield tail by a distance equal to the working stroke of the ram 30. The coupling member 41 is then disengaged from the hole 42, the ram 30 is fully extended, the coupling member is engaged with another hole 42, and the ram 30 is fully retracted again. In this way, the floor skids 28 can be removed from the shield, using their rams 30, in a number of steps. It will be understood that, during this process, the support feet 31 and 32 are extended to contact the tunnel floor 35.

Retraction and removal of the knives 11 and 11' could be effected using their rams 16. It is also possible, however, to withdraw the knives 11 and 11' using auxiliary equipment such as cables or chains.

Preferably, the knives 11 and 11' (and their tail extensions 13) are apertured, so that holes 43 (see FIG. 1) can be drilled in the surrounding earth from the interior of the shield. Grout can then be injected into the holes 43 so as to strengthen the earth to prevent it breaking up when the shield is advanced.

As best seen in FIG. 2, the floor skids 28 are shorter than the knives 11,11', and cutters 44 are provided in front of the floor skids. The cutters 44 are bolted to the floor skids 28 and serve to cut the working face of the tunnel in the regions below the knives 11. The cutters 44 can be removed from the support frame 10 when the shield is being dismantled.

Figure 7:
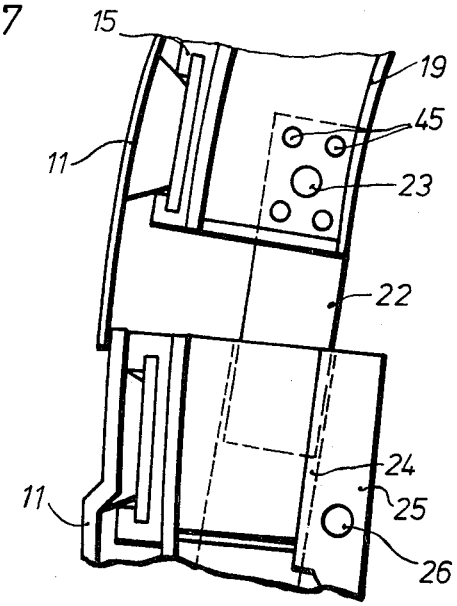
FIG. 7 is an enlarged view of part of the tunnel drive shield.

As shown in FIG. 7, the tongue-like members 22 can be rigidly fixed to their respective wall segments 19 by means of bolts 45. These bolts are removed when it is required to move the tongue-like members 22 within their guide grooves 24 without unnecessary force.

Obviously, a number of modifications could be made to the shield described above. In particular, the hook-shaped coupling members 41 could be replaced by spring-biassed pins attached to the links 38, the pins latching into the apertures 42 in the floor skids 28. Moreover, the foot segments 17 and 18 could be connected by a support structure for a tunnelling machine mounted inside the shield.

I claim:

1. A tunnel drive shield having an arcuate support frame including a pair of foot segments and a plurality of main segments supported by the foot segments, the foot segments being engageable with the tunnel floor, and the main segments being braceable outwardly towards the tunnel walls, each foot segment being provided with at least one floor skid displaceably mounted on the base thereof, wherein each foot segment is provided with at least one vertical-movable support foot, the support feet being movable into contact with the tunnel floor to relieve, at least partially, the load on the floor skids.

2. A tunnel drive shield according to claim 1, wherein the main segments of the support frame carry a plurality of elongate members which are arranged in parallel side-by-side relationship, the elongate members being engageable with the tunnel walls and being movable relative to the support frame in the direction of tunnel advance.

3. A tunnel drive shield according to claim 2, wherein each elongate member is provided with a hydraulic advance ram for advancing that elongate member relative to the support frame.

4. A tunnel drive shield according to claim 3, wherein each elongate member slidably engages a respective guide extending parallel to the longitudinal axis of the shield, whereby the elongate members are removable from the support frame by movement in the longitudinal direction.

5. A tunnel drive shield according to claim 1, wherein each floor skid slidably engages a respective guide extending longitudinally along the base of the corresponding foot segment, whereby the floor skids are removable from the foot segments by movement in the longitudinal direction.

6. A tunnel drive shield according to claim 1, wherein each foot segment is provided with two floor skids.

7. A tunnel drive shield according to claim 1, wherein each foot segment is provided with two longitudinally spaced support feet.

8. A tunnel drive shield according to claim 1, wherein the support feet are movable vertically by means of hydraulic lifting rams.

9. A tunnel drive shield according to claim 1, wherein each support foot is detachably secured to the respective foot segment.

10. A tunnel drive shield according to claim 1, wherein the main segments comprise two wall segments and a ridge segment, each of the wall segments being connected to a respective one of the foot segments, and the two wall segments being joined together, at the top, by the ridge segment.

11. A tunnel drive shield according to claim 10, wherein the base of each wall segment is connected to its foot segment by telescopic guide means, and the top of each wall segment is connected to the ridge segment by telescopic guide means.

12. A tunnel drive shield according to claim 11, wherein the telescopic guide means at the base of each wall segment includes a first telescopic guide situated adjacent to each end thereof, and the telescopic guide means at the top of each wall segment includes a second telescopic guide situated adjacent to each end thereof.

13. A tunnel drive shield according to claim 12, wherein each first telescopic guide includes a tongue-like member attached to the respective wall segment, and a grooved guide member attached to the corresponding foot segment, each tongue-like member being a telescopic fit within its grooved guide member.

14. A tunnel drive shield according to claim 13, wherein the tongue-like member of each first telescopic guide is completely removable from its grooved guide member when the support frame is braced outwardly, and the elongate members and the floor skids have been removed.

15. A tunnel drive shield according to claim 12, wherein each second telescopic guide includes a tongue-like member attached to the ridge segment, and a grooved guide member attached to the respective wall segment, each tongue-like member being a telescopic fit within its grooved guide member.

16. A tunnel drive shield according to claim 12, further comprising hydraulic rams for bracing the main segments of the support frame outwardly towards the tunnel walls.

17. A tunnel drive shield according to claim 16, wherein at least one of said hydraulic bracing rams is associated with, and acts generally in the direction of, each of the telescopic guides.

18. A tunnel drive shield according to claim 13, wherein the tongue-like member of each first telescopic guide is pivotally attached to its wall segment.

19. A tunnel drive shield according to claim 18, wherein the tongue-like member of each first telescopic guide is provided with detachable means for securing that tongue-like member rigidly to its wall segment.

20. A tunnel drive shield according to claim 13, wherein the tongue-like members of the first telescopic guides are detachably secured to their wall segments.

21. A tunnel drive shield according to claim 2, wherein each elongate member is provided with openings through which holes can be drilled in the tunnel walls from the inside of the shield.

22. A tunnel drive shield according to claim 1, further comprising cutters disposed forwardly of the floor skids, the cutters being detachably secured to the support frame.

23. A tunnel drive shield according to claim 10, wherein each wall segment includes a plurality of detachably connected segment parts.

24. A tunnel drive shield according to claim 1, wherein each floor skid is provided with a hydraulic advance ram for advancing that floor skid relative to its foot segment.

25. A tunnel drive shield according to claim 24, wherein each floor skid is provided with a plurality of longitudinally-spaced engagement points for its associated hydraulic advance ram, whereby said ram can be used to displace that floor skid in the rearward longitudinal direction relative to its foot segment.

26. A tunnel drive shield according to claim 1, wherein the base of each floor skid is curved upwardly at its rearward end.

* * * * *